United States Patent [19]

Fu

[11] Patent Number: 5,005,512

[45] Date of Patent: Apr. 9, 1991

[54] PORTABLE EXTENSIBLE FLAG POLE WITH A FLAG

[76] Inventor: Shan C. Fu, No. 38, Alley 316, Ta Shun 3rd Rd., Kaohsiung, Taiwan

[21] Appl. No.: 500,941

[22] Filed: Mar. 29, 1990

[51] Int. Cl.[5] ..... G09F 17/00

[52] U.S. Cl. ..... 116/173

[58] Field of Search ..... 116/173, 174, 209

[56] References Cited

U.S. PATENT DOCUMENTS

| | | | |
|---|---|---|---|
| 1,896,832 | 2/1933 | Wiley | 116/173 |
| 2,061,361 | 11/1936 | Lane | 116/173 |
| 2,452,842 | 11/1948 | Davis | 116/173 |
| 2,458,316 | 1/1949 | Swertlow | 116/173 |
| 2,533,459 | 12/1950 | Holliday | 116/173 |
| 3,760,441 | 9/1973 | Handelman | 116/173 |
| 4,800,834 | 1/1989 | Feng | 116/173 |

*Primary Examiner*—Harry N. Haroian

*Attorney, Agent, or Firm*—Fleit, Jacobson, Cohn, Price, Holman & Stern

[57] ABSTRACT

A portable extensible flag pole with a flag comprising an extensible tubular pole consisting of more than two pole tubes with different size and a flag possible to be rolled around a shaft in the smallest pole tube such that the flag pole can be lengthened or shortened.

2 Claims, 3 Drawing Sheets

PORTABLE EXTENSIBLE FLAG POLE WITH A FLAG

BACKGROUND OF THE INVENTION

A common portable flag pole with a flag tied on has a definite length impossible to be extended or shortened and the flag is apt to get dirty unless it is loosened from the pole and stored away.

SUMMARY OF THE INVENTION

The object of this invention is to provide a portable extensible flag pole with a flag, wherein its length can be lengthened for use or shortened for storing it away and the flag can be rolled around a shaft in an inner tube fixed in one of the flag pole tubes when not in use.

This invention comprises a tubular pole consisting of two or more pole tubes of different diameter, an inner tube, a shaft, a spherical cap and a cloth flag as the main components.

The pole tubes of different diameter are combined together be means of male-threaded rings possible to screw tight with or loosen from the distal male-threaded portion of each pole tube. Each smaller diameter pole tube can be pushed in or pulled out of a bigger size pole tube by loosening or screwing tight the female-threaded rings, and thereby the flag pole can be lengthened for use or shortened for storing away.

The inner tube is to be contained in the smallest diameter pole tube, provided with a lengthwise straight slot and a pin hole near the inner end of the slot for a pin to combine a shaft ring for supporting the lower end of a shaft, which is to be contained in the inner tube and to be rotated with the spherical cap for rolling the flag around the shaft in storing it away.

The shaft has both ends of smaller size than the body and the upper end is provided with a vertical slot for a moving plate to insert and extends outside a shaft ring supporting the upper end.

The spherical cap has an interior groove for the moving plate and the upper end of the shaft to fit therein such that rotating the spherical cap can also cause the shaft to rotate at the same time so that the flag having its inner end glued on the shaft can be rolled around the shaft in storing away.

DETAILED DESCRIPTION OF THE INVENTION

Figure 1:
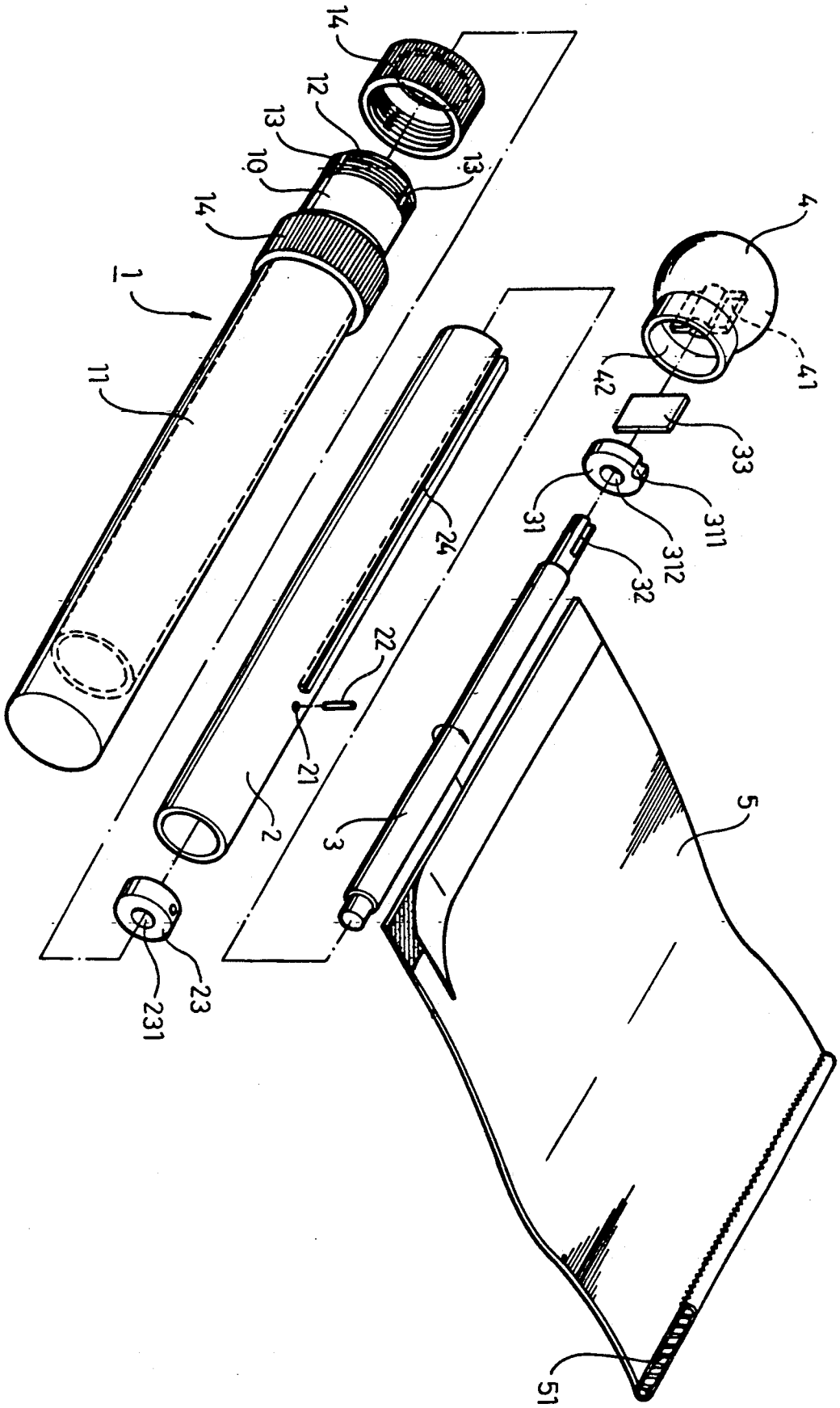
FIG. 1 is an exploded perspective view of the portable extensible flag pole with a flag in accordance with the present invention.

This portable extensible flag pole with a flag comprises an extensible tubular pole 1, an inner tube 2, a shaft 3, a spherical cap 4, and a flag as the main components.

The extensible tubular pole 1 consists of two or more tubes, for example, a small diameter pole tube 10 and a large diameter pole tube 11 containing the small tube 10 possible to be pulled out. The upper ends of both pole tubes 10 and 11 have male-threaded portions 12 cut with vertical split gaps 13 at the outer ends and the male-threaded portion 12 are for female-threaded rings 14 to screw with and force the walls of the pole tubes 10 and 11 to shrink inward so that the inner tube 2 or the pole 10 can be tightly kept in position. On the contrary, the pole tube 10 or the inner tube 2 can be extended out or shortened in for changing the length of tubular pole 1 by loosening the female-threaded rings 14.

The inner tube 2 is to be contained in the small diameter tube 10, provided with a pin hole 21 near the inner end of a straight slot 24 for a pin 22 to fit in so as to combine the inner tube 2 with a shaft ring 23 having a central hole 231 for the lower end of the shaft 3 to fit in and to be sustained and rotate therein. The inner tube 2 is also provided with the lengthwise straight slot 24 for one side end of a flag to pass therethrough, and the spherical cap 4 can fit around one end of the upper end of the inner tube 2.

The shaft 3 is contained and can rotate in the inner tube 2, having one of its end fitting and being able to rotate in the central hole 231 in the shaft ring 23, and the other end of smaller diameter than the body fitting in the central hole 312 of another shaft ring 31 and having a vertical slot 32 for a moving plate 33 to fit in. The body of the shaft 3 is to be glued with one side end of the flag 5 so that the flag can be rolled around the shaft 3 when it is rotated.

The shaft ring 31 fits in the upper end of the inner tube 2, provided with a groove 311 to touch the bottom of the straight slot 24 thereof and the central hole 312 for the upper end of the shaft 3 to fit and rotate therein. The vertical slot 32 of the shaft extends outside of the shaft ring 31 for the moving plate 33 to fit in, and the moving plate 33 also fits in a groove 421 of the spherical cap 4.

The flag 5 is made of cloth, having the inner side end firmly glued with the shaft 3 and the outer side end 51 made thicker than itself and wider than the straight slot 24 in the inner tube 2 so that the flag 5 can be prevented from completely rolled in the inner tube 2, said outer side end stopped by the slot 24.

Figure 2:
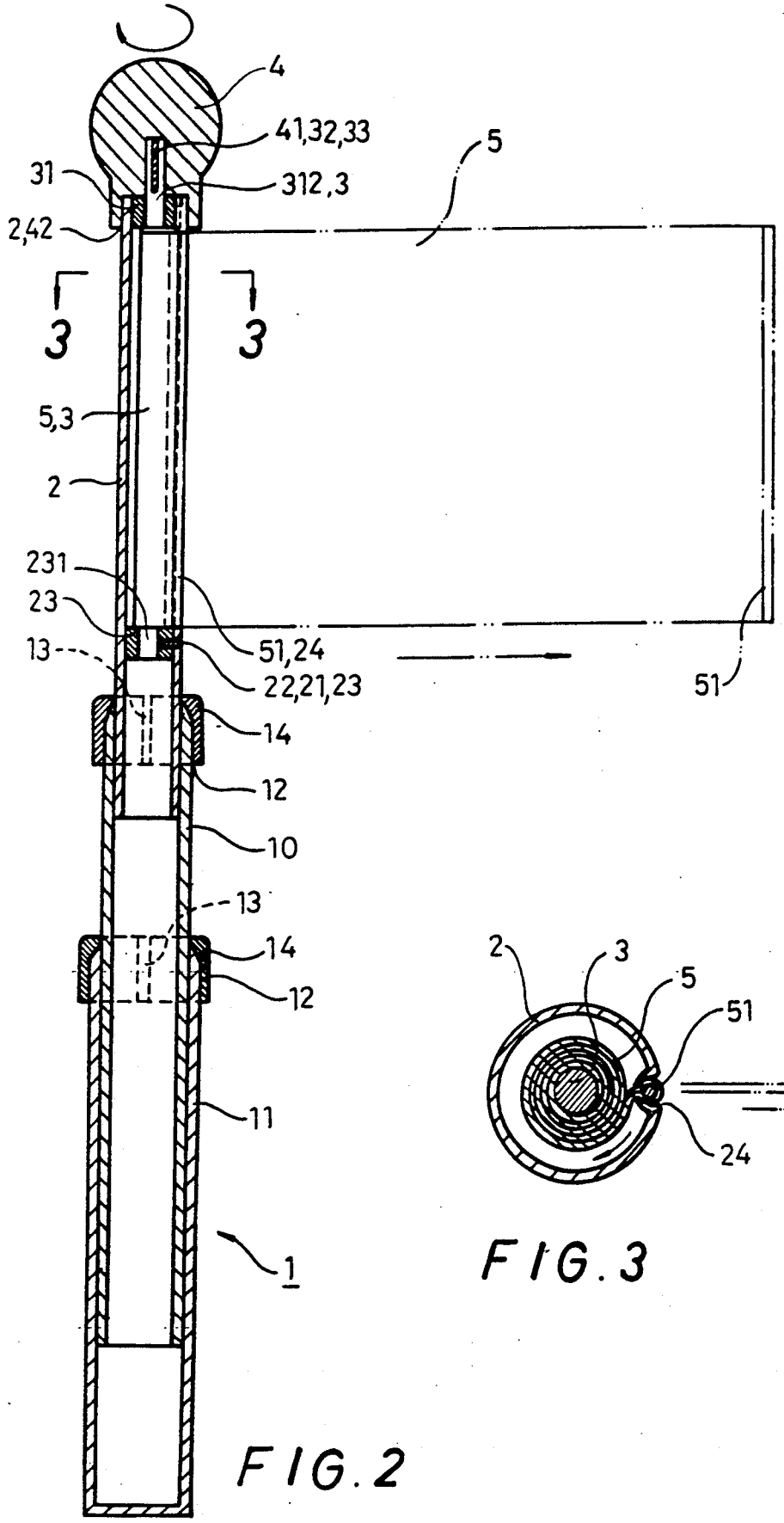
FIG. 2 is an cross-sectional view of the portable extensible flag pole with a flag in accordance with the present invention.
Figure 3:
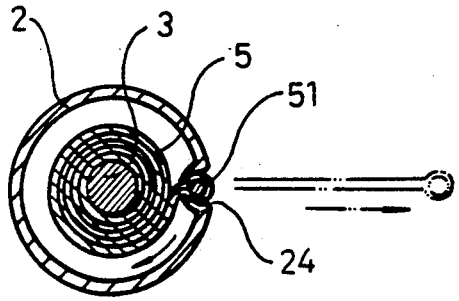
FIG. 3 is a cross-sectional view taken along line 3—3 line of FIG. 2.

Next, referring to FIG. 2, the inner tube 2 is contained in the small size pole tube 14, the shaft 3 being kept between shaft rings 23 and 31, the flag 5 having one end fixed on the shaft 3 and the other extending out of the straight slot 24 in the inner tube 2, the spherical cap 4 being mounted on the top of the shaft 3 with the moving plate 33 inserted between the shaft 3 and the cap 4 so that the flag 5 can be rolled around the shaft 3 until the outer end of the flag 5 is stopped by the slot 24 in the inner tube 2 if the cap 4 is rotated. Besides, the adjacent walls of the slot 24 are curved down such that the outer thicker end of the flag 5 can just sink in the curvature of the slot 24, being at the same level of the outer surface of the inner tube 2. Therefore, the inner tube 2 can be contained in the small size pole tube 10.

Figure 4:
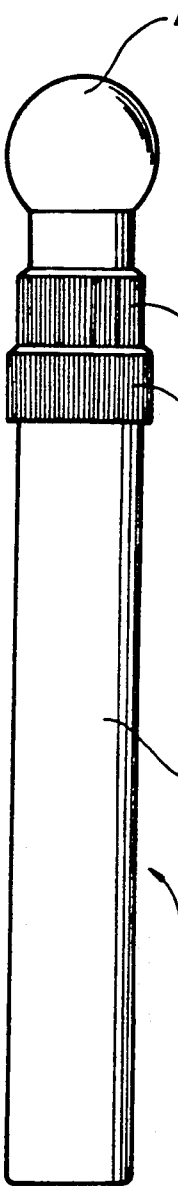
FIG. 4 is a front view of the portable extensible flag pole shortened in the small size in this invention.

FIG. 4 shows the extensible tubular pole 1 are shortened in the small size, by loosening the rings 14, pulling out the small size pole tube 10 and screwing tight the rings 14 again.

Figure 5:
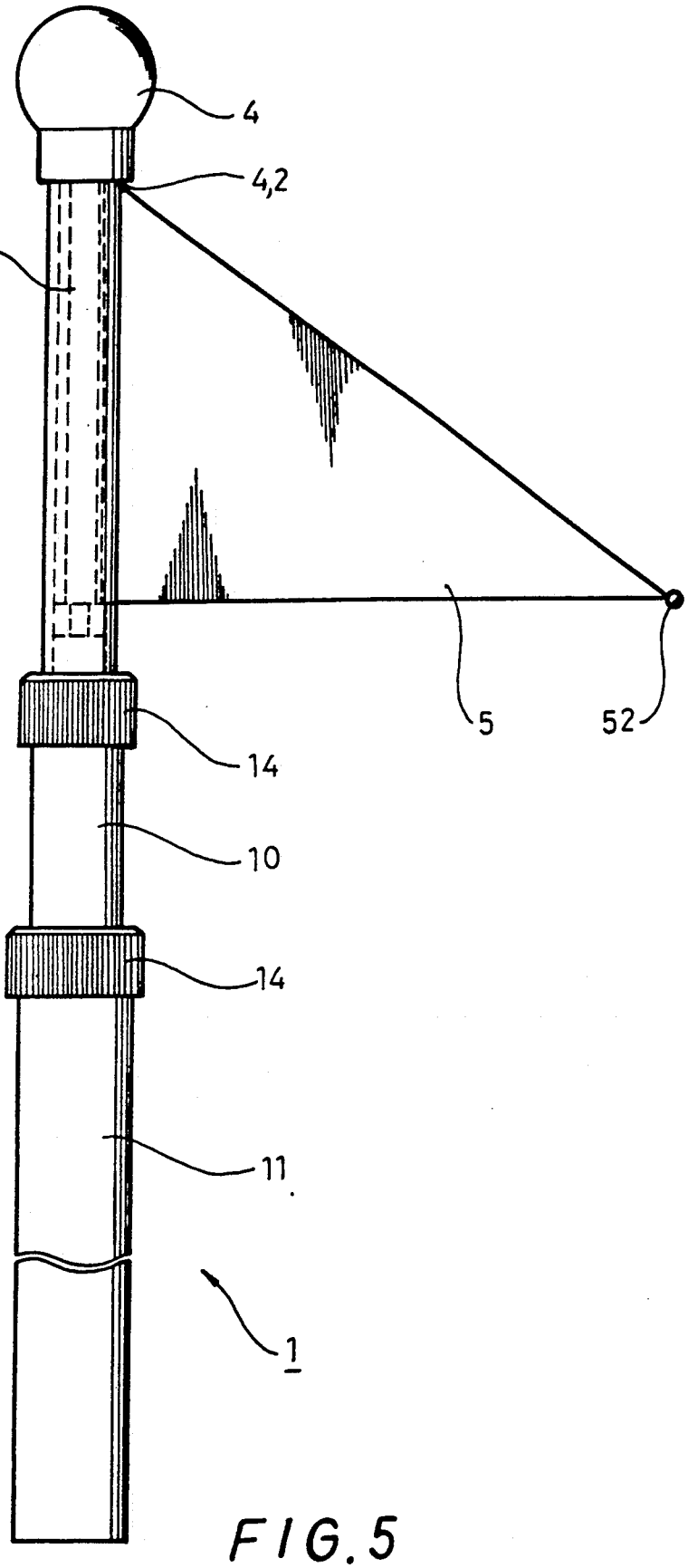
FIG. 5 is a front view of the portable extensible flag pole extended out in the large size in this invention.

However, if the flag 5 has a triangle shape as a pennant shown in FIG. 5, a bead 52 of larger size than the slot 24 in the inner tube 2 can be attached at the outer tip of the flag 5 to prevent it from being completely rolled in the inner tube 2.

In short, this invention can be stored away with the flag rolled in without any fear of getting dirty, and shortened in the small size as to be used as a baton or stored away.

What is claimed is:

1. A portable extensible flag pole with a flag comprising:

an extensible tubular pole assembly having at least two pole tubes of different diameter, including a smaller size pole tube telescopically mounted in a bigger size pole tube, each of said pole tubes having a distal male-threaded portion a female-threaded ring on each of said male-threaded portions, said distal male-threaded portion of each pole tube having several vertical split gaps useful for the female-threaded ring on the bigger tube to screw tight the bigger size pole tube around the smaller size pole tube, and the smallest size pole tube being able to contain an inner tube therein;

an inner tube having a lengthwise straight slot for the body of a flag to pass through, a pin hole near the inner end of said slot for a pin to connect a shaft ring with the inner tube and the shaft ring having a central hole for the lower end of a shaft to fit and be able to rotate in the inner tube;

a shaft having both ends of smaller size than the shaft body, a shaft ring rotatably mounted on each end of the shaft, one end of the shaft having a vertical slot located beyond the respective shaft ring and having a moving plate inserted therein;

a spherical cap having a groove in the interior for the moving plate and said one end of the shaft to insert therein and a round opening for the inner tube to fit in, said cap being able to be rotated manually to rotate the shaft at the same time for rolling a flag around the shaft for storing it away in the inner tube; and a flag having an inner end glued on the shaft body and an outer end thicker than the width of the straight slot in the inner tube the flag being rolled around the shaft with the outer end being located outside said slot, to allow unrolling and rolling up of the flag by rotating the cap and so as to prevent the flag from being completely rolled onto the shaft.

2. The portable extensible flag pole with a flag as claimed in claim 1, wherein the flag is shaped as a triangle having the outer end formed as a tip with a bead of larger size than the width of the slot in the inner tube so that the bead can be stopped by the slot and does not extend out of the outer diameter of the inner tube.

* * * * *